US007287295B2

(12) United States Patent
Treacy et al.

(10) Patent No.: US 7,287,295 B2
(45) Date of Patent: Oct. 30, 2007

(54) HANDLE HAVING DISPOSABLE CLEANING HEAD

(75) Inventors: Terrence Treacy, Mansfield, TX (US); Diethard Trenz, Klagenfurt (AT); Markus Enzfellner, Ebenthal (AT)

(73) Assignee: Hagleitner Hygiene International GmbH, Zell am See (AT)

( * ) Notice: Subject to any disclaimer, the term of this patent is extended or adjusted under 35 U.S.C. 154(b) by 580 days.

(21) Appl. No.: 10/680,016

(22) Filed: Oct. 7, 2003

(65) Prior Publication Data

US 2004/0129296 A1 Jul. 8, 2004

Related U.S. Application Data

(63) Continuation-in-part of application No. 10/069,993, filed as application No. PCT/AT00/00235 on Aug. 30, 2000, now Pat. No. 6,745,427.

(30) Foreign Application Priority Data

Sep. 1, 1999 (AT) ..... A 1507/99

(51) Int. Cl.
*A47K 11/10* (2006.01)

(52) U.S. Cl. ..... 15/210.1; 15/209.1; 15/225; 15/226

(58) Field of Classification Search ..... 15/147.1, 15/147.2, 209.1, 210.1, 223–226
See application file for complete search history.

(56) References Cited

U.S. PATENT DOCUMENTS

| | | | | |
|---|---|---|---|---|
| 1,534,300 | A | 4/1925 | Coltrane | |
| 1,636,196 | A | 7/1927 | Robbins | |
| 1,665,153 | A | 4/1928 | Withycombe | |
| 2,038,958 | A * | 4/1936 | Reach | 401/201 |
| 2,443,233 | A | 6/1948 | Filardo | |
| D159,243 | S | 7/1950 | Atwood | |
| 2,610,347 | A | 9/1952 | Kleiner | |
| 2,666,223 | A | 1/1954 | Farrell | |
| 2,666,224 | A | 1/1954 | Adams | |
| 2,668,974 | A | 2/1954 | Jaeger | |
| 2,755,497 | A | 7/1956 | Greacen, Jr. | |
| 2,813,286 | A | 1/1957 | Strader | |
| D181,611 | S | 12/1957 | Schumann | |
| D181,696 | S | 12/1957 | Williams | |
| 3,188,675 | A | 6/1965 | Beck | |
| 3,333,290 | A | 8/1967 | Leader | |
| 4,031,673 | A | 6/1977 | Hagelberg | |
| 4,075,033 | A * | 2/1978 | Knox et al. | 134/6 |
| 4,362,174 | A | 12/1982 | Baker et al. | |
| 4,457,038 | A | 7/1984 | Hammond | |

(Continued)

FOREIGN PATENT DOCUMENTS

| | | |
|---|---|---|
| DE | 33 20 586 A1 | 12/1984 |

(Continued)

*Primary Examiner*—Mark Spisich
(74) *Attorney, Agent, or Firm*—Laurence A. Greenberg; Werner H. Stemer; Ralph E. Locher

(57) ABSTRACT

A cleaning apparatus including: (1) a substantially hollow tubular body having a bore extending therein, (2) actuation means operably coupled to the body and including a plunger disposed within the body and (3) a cleaning head detachably coupled to the body, wherein actuation of the plunger ejects the cleaning head from the body.

25 Claims, 9 Drawing Sheets

U.S. PATENT DOCUMENTS

| | | | | |
|---|---|---|---|---|
| 4,987,634 | A | 1/1991 | Weihrauch | |
| 5,214,820 | A | 6/1993 | Shumway et al. | |
| 5,471,697 | A | 12/1995 | Daconta | |
| 5,609,255 | A * | 3/1997 | Nichols | 206/576 |
| 5,630,243 | A | 5/1997 | Federico et al. | |
| 5,755,003 | A | 5/1998 | Altemare et al. | |
| 5,875,512 | A | 3/1999 | Lathan | |
| 6,094,771 | A | 8/2000 | Egolf et al. | |
| 6,158,077 | A | 12/2000 | Wenger et al. | |
| 6,182,322 | B1 | 2/2001 | Tubman | |
| 6,507,972 | B2 | 1/2003 | Hart | |
| 6,996,871 | B1 * | 2/2006 | Policicchio | 15/228 |
| 2002/0007527 | A1 * | 1/2002 | Hart | 15/104.94 |

FOREIGN PATENT DOCUMENTS

| | | | |
|---|---|---|---|
| DE | 85 210 62 US | | 2/1988 |
| DE | 92 109 32 UI | | 11/1993 |
| DE | 29709610 | * | 9/1997 |
| DE | 29914342 | * | 1/2000 |
| JP | 8-122219 | | 10/1994 |
| JP | 8-150099 | * | 6/1996 |
| WO | 96/37140 | * | 11/1996 |
| WO | WO 97/49312 | | 6/1997 |
| WO | WO 97/49315 | | 6/1997 |

* cited by examiner

HANDLE HAVING DISPOSABLE CLEANING HEAD

CROSS-REFERENCE

This application is a continuation-in-part of U.S. Application Ser. No. 10/069,993 filed on Mar. 1, 2002 now U.S. Pat. No. 6,745,427, which is a U.S. National Phase Application of PCT Application No. PCT/AT00/00235 filed on Aug. 30, 2000, which claims priority to Austrian Application No. AT1507/99 filed on Sep. 1, 1999, which is hereby incorporated by reference.

The following related patent applications are hereby made of record and incorporated by reference: U.S. Design patent application Ser. No. 29/193,178, filed Nov. 5, 2003; U.S. Design patent application Ser. No. 29/193,177, filed Nov. 5, 2003; and U.S. Design patent application Ser. No. 29/193,235, filed Nov. 5, 2003.

BACKGROUND

The present disclosure relates generally to a handle for cleaning purposes and, more specifically, to a handle having a disposable cleaning head.

Traditional brushes, in particular toilet brushes, pose a hygienic problem because the cleaning head provides a fertile medium for bacteria and fungi. In addition to the unattractive appearance of the brush after repeated use, the contamination of the cleaning head can lead to health hazards for the user.

Accordingly, what is needed in the art is a toilet brush that addresses the above-discussed issues.

SUMMARY

The present disclosure provides a cleaning apparatus including a body, an actuator operably coupled to the body, and a flushable cleaning head detachably coupled to the body and removable from the body in response to actuation of the actuator. In another embodiment, the cleaning apparatus includes a substantially hollow tubular body having a bore extending therein. The cleaning apparatus may also include actuation means operably coupled to the body and including a plunger disposed within the body. A cleaning head may be detachably coupled to the body, such that actuation of the plunger ejects the cleaning head from the body.

A disposable cleaning head for use with a handle is also introduced in the present disclosure. In one embodiment, the disposable cleaning head is detachably couplable to the handle and includes a plurality of bristles having ends collectively forming a cleaning surface. The disposable cleaning head also includes a sleeve retaining portions of ones of the plurality of bristles, and may also include a plurality of bridges connecting ones of the plurality of bristles.

A handle for use with a disposable cleaning head is also provided in the present disclosure. In one embodiment, the handle includes a substantially hollow tubular body having a bore extending at least partially therein. A plunger head is disposed within the bore proximate an end of the body. Such an embodiment of the handle also includes a retainer configured to temporarily engage the disposable cleaning head, wherein actuation of the plunger head ejects the disposable cleaning head from the retainer.

A disposable cleaning head dispenser is also introduced in the present disclosure. In one embodiment, the dispenser includes a housing and a plurality of disposable cleaning heads stored in the housing. A retainer detachably coupled to the housing includes a plurality of selectively removable portions each providing access to a corresponding one of the plurality of disposable cleaning heads.

The present disclosure also provides a cleaning kit. The cleaning kit includes a dispenser and at least one disposable cleaning head stored in the dispenser. The cleaning kit also includes a handle having an end configured to detachably retain the disposable cleaning head.

The present disclosure also provides a method of cleaning a surface including providing a body and inserting a cleaning head into the body such that the cleaning head is retained in the body. The cleaning head is contacted against the surface to clean the surface. The cleaning head is then ejected from the body.

The foregoing has outlined preferred and alternative features of several embodiments so that those skilled in the art may better understand the detailed description that follows. Additional features will be described below that further form the subject of the claims herein. Those skilled in the art should appreciate that they can readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
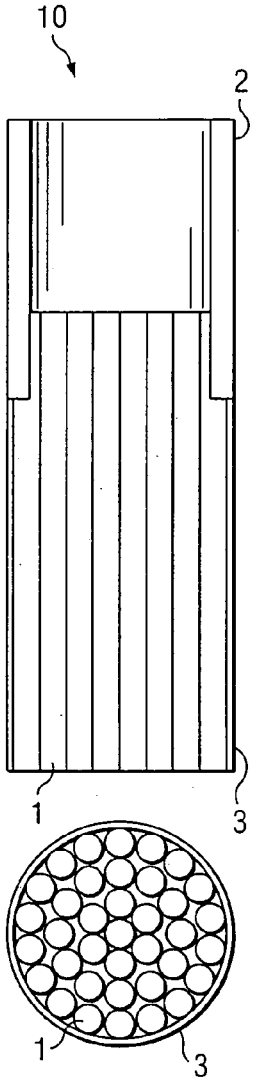
FIG. 1 shows a cleaning head according to the invention schematically in a longitudinal section and in a horizontal projection.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the coupling of a first feature to a second feature in the description that follows may include embodiments in which the first and second features are directly coupled, and may also include embodiments in which additional features may be coupled interposing the first and second features, such that the first and second features may not be directly coupled.

Figure 2:
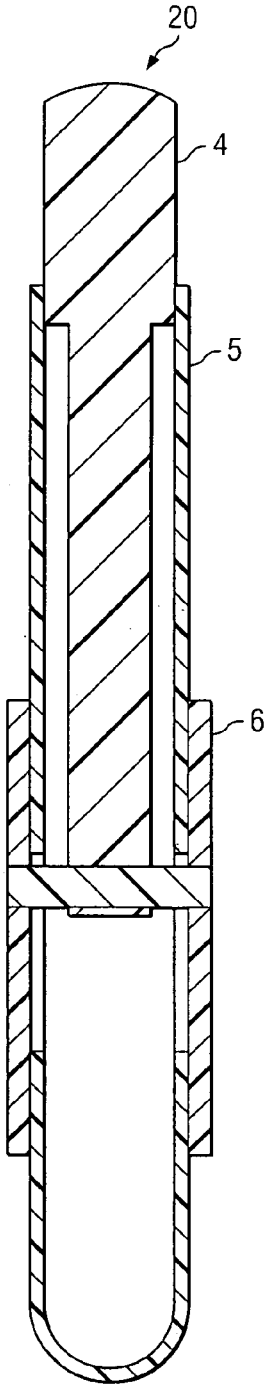
FIG. 2 shows an embodiment of a cleaning head holder of the invention in a longitudinal section.
Figure 3:
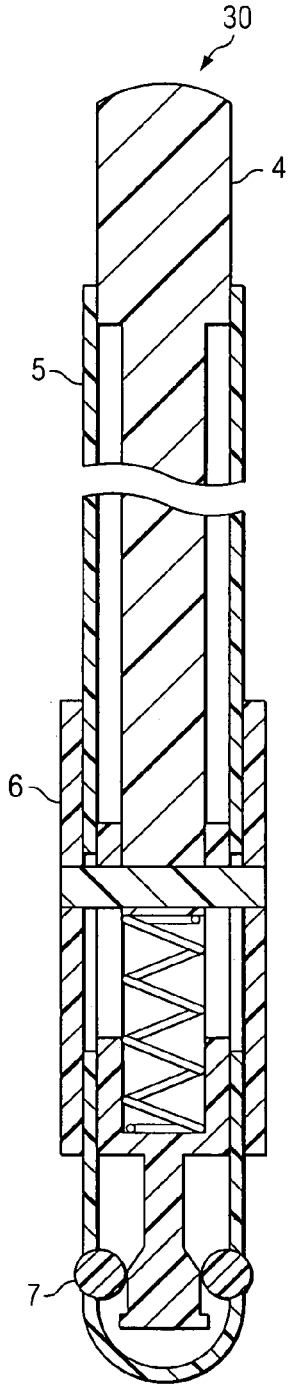
FIG. 3 shows an alternative embodiment of a cleaning head holder of the invention in a longitudinal section.

Referring to FIGS. 1-3 collectively, illustrated are sectional views of an embodiment of a cleaning head 10, a first embodiment of a brush holder 20 and a second embodiment of a brush holder 30, respectively, comprising various components of a cleaning apparatus constructed according to aspects of the present invention. That is, the cleaning apparatus, shown as executed as a toilet brush, may comprise a cleaning head 10, as shown in FIG. 1, and a cleaning head holder as indicated in FIG. 2 in general by the number 20 and in FIG. 3 in general by the number 30. The cleaning head may be executed as a one-way cleaning head consisting of a sleeve 2 that precisely fits the cleaning head holder 20, 30. If necessary, the sleeve 2 may be supplemented by an extension tube made of cellulose or the like in order to be able to effectively clean hard-to-reach places in toilet bowls, etc. Connected to the sleeve 2 may be several rolled-up strips of paper or similar material that serve as bristles 1 and that may be held together by a protective cover 3. Prior to using the one-way brush, the protective cover 3 must be removed, allowing the bristles 1 of the cleaning head 10 to unfold. After use, the cleaning head may be discarded by means of a push button 4 on the cleaning head holder 20, 30 and disposed of in a toilet, waste receptacle or the like.

The cleaning heads of the invention may comprise a well-degradable material, possibly a material that is easily soluble in water, e.g., one similar to toilet paper. The cleaning heads may be formed form cellulose or a water-soluble plastic that can be made from replenishable raw materials. Such water-soluble plastic can be processed like normal plastic in jet moldings, but may have the advantage that the cleaning heads made of this material can also be disposed of via the toilet due to its water solubility. Furthermore, the cleaning head can be impregnated with scent, cleaning and/or disinfection agents, with these agents possibly being used in gel form.

The cleaning head holder 20, 30 may comprise a handle 5 made of metal, PVC or similar material to which the cleaning heads may be assembled. The cleaning head holder may also be equipped with a mechanism 6 that makes it possible to slide off the cleaning heads by means of the push button 4 on the handle. The cleaning head holder 30 according to FIG. 3 furthermore is equipped with a ball mechanism 7 that firmly locks the cleaning head in position after it has been assembled. FIG. 2 shows a simpler solution provided for manual use by hand [sic]. However, the model according to FIG. 3 may provide more secure retaining of the cleaning head on the brush holder and is intended for use with a one-way cleaning head dispenser.

Such a one-way cleaning head dispenser may comprise, e.g., a storage container with several cleaning heads that drops in front of a removal opening by force of gravity or a spring. Several small knives may be arranged around the removal opening that tear open the protective cover of the cleaning head when it is pulled out of the removal opening. The cleaning head holder may be inserted through the removal opening into the cleaning head and automatically locked in place by means of the ball mechanism. When the one-way brush is pulled out, the protective cover of the cleaning head may thus be torn open and the one-way toilet brush is instantly ready to use. One embodiment of this process is shown in FIG. 7 in the sequence a) through d). In step a), a magazine for the storage container may first be mounted on a wall with screws or, alternatively, with adhesive tape. The magazine has a front wall that can be folded out and whose lower end has an opening for the insertion of the cleaning head holder. In step b), the storage container is placed into the magazine, and it can be seen that the brush sits in a holder on the right side of the magazine. In step c), the cleaning head holder is pressed against a cleaning head, and the brush is thus ready to use. In step d), the cleaning process may be carried out.

Figure 4:
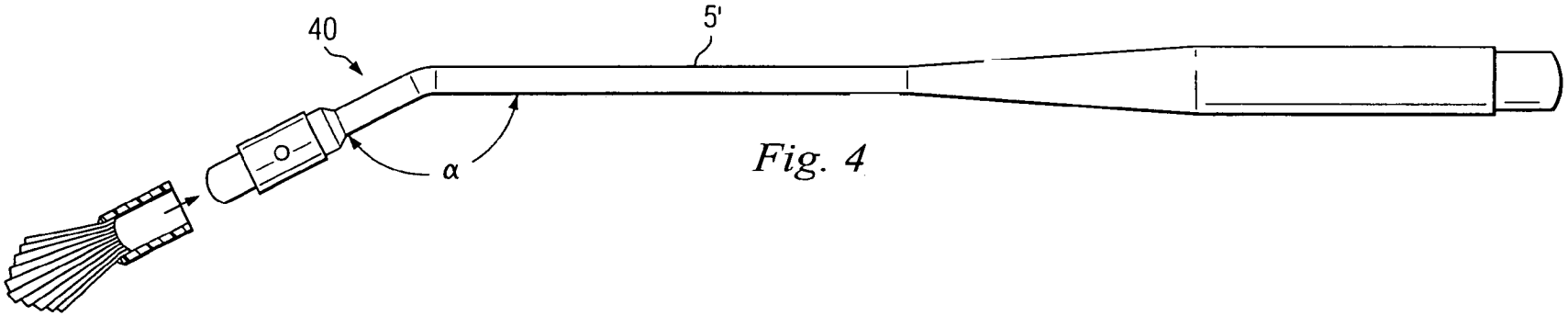
FIG. 4 shows an alternative embodiment of a cleaning head holder according to the invention in a lateral view.
Figure 5:
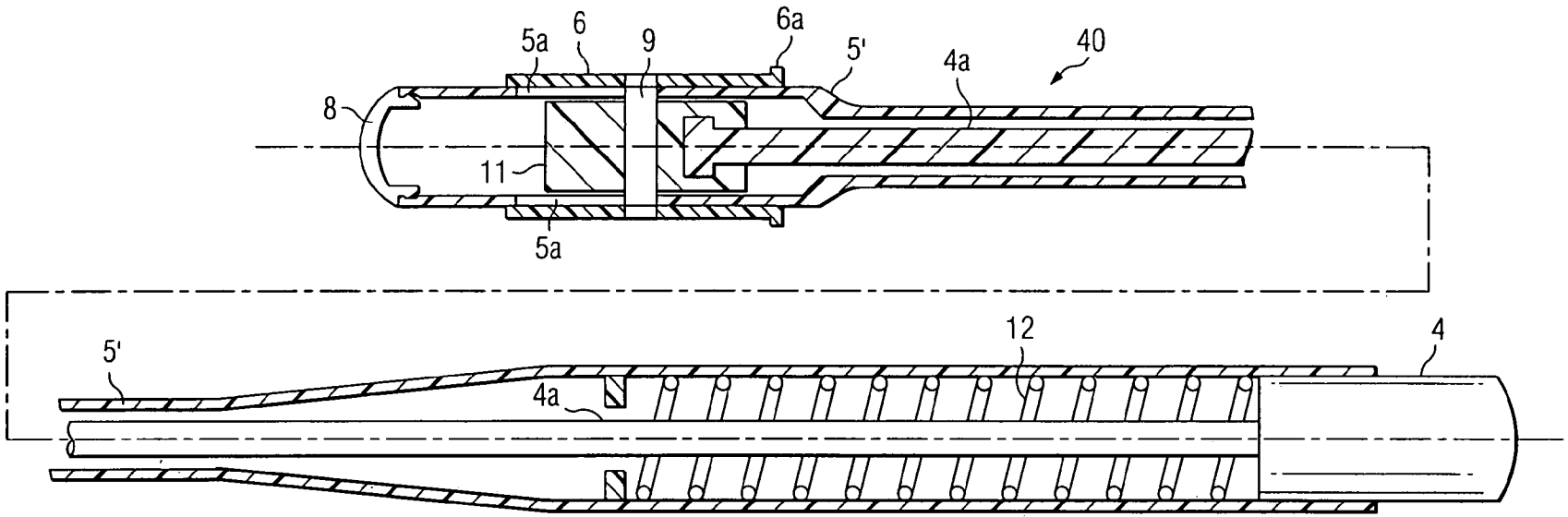
FIG. 5 shows the cleaning head holder of FIG. 4 in a longitudinal section

FIG. 4 illustrates a side view of another embodiment of a cleaning head holder 40 constructed according to aspects of the present disclosure. It differs from the models described above in that the handle 5' is equipped with a bend a of approximately 155°. The bend may make cleaning hard-to-reach places in toilet bowls easier. FIG. 5 illustrates a sectional view of an embodiment of the cleaning head holder of FIG. 4 that, for space reasons, was separated into two segments. From FIG. 5, one can recognize additional differences of this embodiment of the cleaning head holder vis-à-vis those of FIGS. 2 and 3. The cleaning head holder 40 features a movable connection element 11 split lengthwise at the end of the cleaning head side in the interior of the handle 5' that interlocks with a flexible extension 4*a* of the push button 4 and which transfers translation motions of the push button 4 to the sleeve-shaped ejection mechanism 6 via a bolt 9 that can slide in oblong slots 5*a* of the handle 5'. The ejection mechanism 6 features a flange 6*a* that serves as a stopper for the protective cover of the cleaning head. The protective paper cover is pushed back to the stopper. The spring 12 resets the push button 4 to its starting position. In addition, a cap 8 that can be forced on by pressure closes the tube-shaped handle 5' off.

Figure 6:
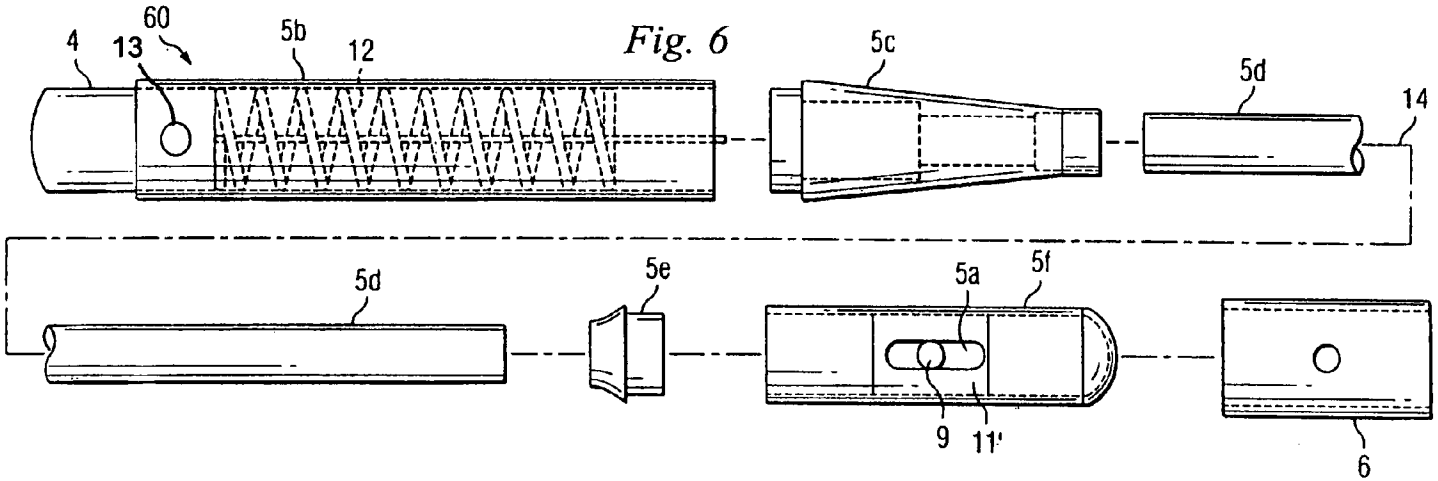
FIG. 6 shows an alternative cleaning head holder according to the invention in a longitudinal section.
Figure 7D:
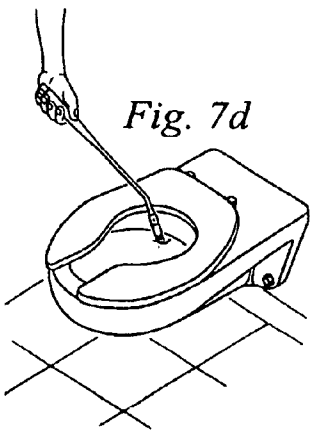
FIGS. 7*a*-7*d* show in four models the utilization of the cleaning head holder together with a cleaning head dispenser.
Figure 7C:
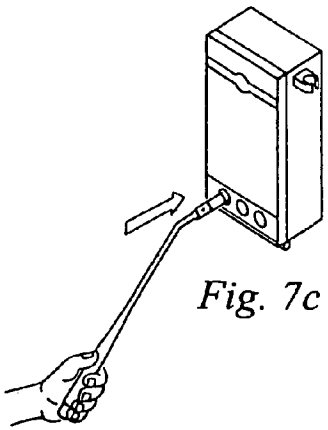
Figure 7B:
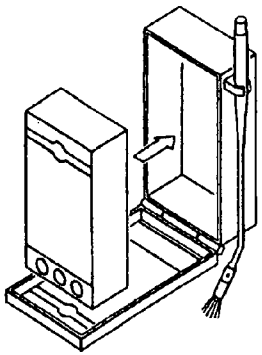
Figure 7A:
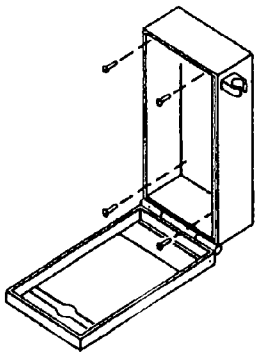

FIG. 6 illustrates a schematic view of another embodiment of a cleaning head holder 60 constructed according to aspects of the present disclosure. It differs from the design models of FIGS. 4 and 5 mainly in that the handle comprises several parts, namely a grip part 5*b*, a cone part 5*c*, a connection tube 5*d*, another connection part 5*e* and a head part 5*f* that features the oblong slots 5*a* for the bolt 9 which traverses the connection part 11'. The ejection mechanism 6 is pushed over the head part 5*f*. The parts of the handle may be formed of plastic or stainless steel, and may be cemented or otherwise adhered together. In contrast with the previous model, the push button 4 does not feature an extension, but is connected by means of a stud screw 13 to a relative stiff stainless-steel wire 14 whose other end locks into the connection part 11'. The wire 14 transmits the translation motions of the push button 4 to the connection part 11'. The spring 12 again serves to reset the push button 4 to its starting position. The connection tube 5*d* of the handle is bent prior to the assembly in order to create the aforementioned bend.

Figure 8:
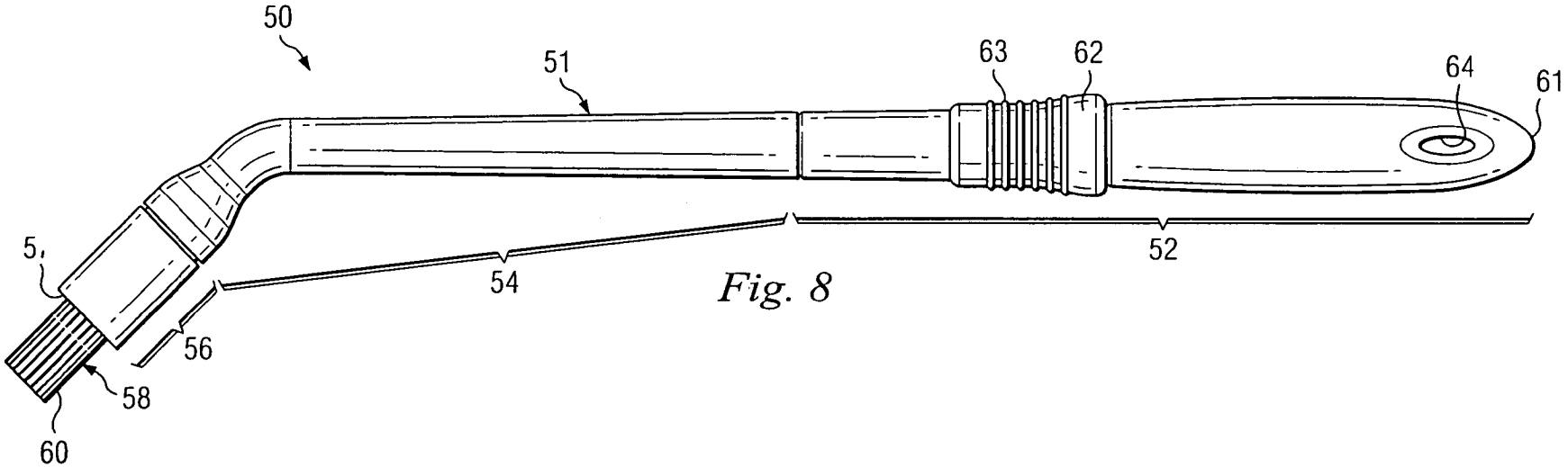
FIG. 8 illustrates a side view of one embodiment of a handle constructed according to aspects of the present disclosure.
Figure 9:
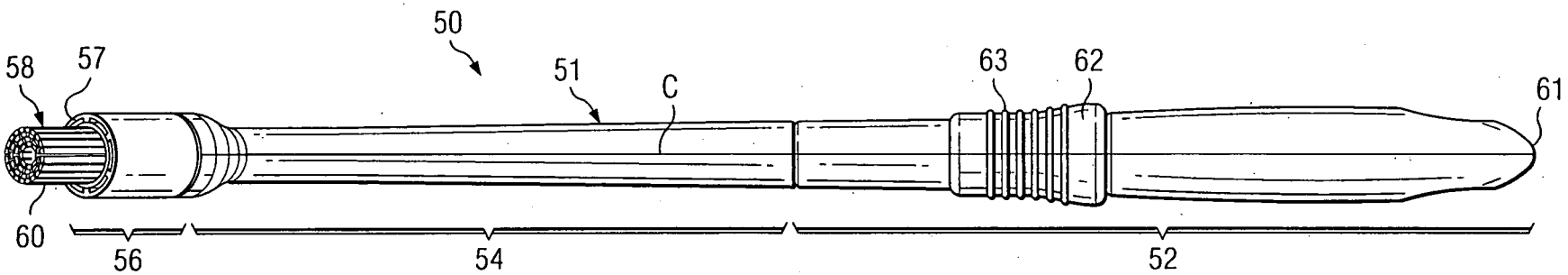
FIG. 9 illustrates a bottom view of the handle shown in FIG. 8.

Referring to FIGS. 8 and 9, illustrated are side and bottom views of one embodiment of a handle 50 constructed according to aspects of the present disclosure. The handle 50 may include a substantially hollow tubular body 51 which may include a bore extending through a major portion thereof, such as the embodiments described below with reference to FIGS. 10 and 11. The body 51 may generally include a handle section 52, a middle section 54, and a cleaning head section 56, all of which may be formed of any suitable material, such as ABS or PVC plastic, by injection-molding and/or other processes. The body 51 may be formed in any number of sections, including unitarily. However, for the sake of clarity, the body 51 will be described hereafter with respect to the above-described sections. For ease of construction, the handle section 52 and the middle section 54 may each comprise two substantially identical halves that are mirror images. However, the portions of the body 51 are not limited to such construction within the scope of the present disclosure.

The cleaning head section 56 houses a cleaning head 58 located adjacent or proximate an end 57 of the body 51. The cleaning head 58 may comprises a cleaning means 60, such as the embodiments described below with reference to FIG. 14. The cleaning means 60 may comprise bristles, fibers, cotton and/or paper masses, unitary cloth, and/or various other materials or arrangements.

The handle section 52 includes an actuation means 62 adjacent or proximate a second end 61 of the body 51. For example, in the illustrated embodiment, the actuation means 62 is within grasping distance of the second body end 61, possibly between about 3 inches and about 8 inches, and further away from the first body end 57 than the average water depth in a conventional toilet bowl. In one embodiment, the actuation means 62 comprises a collar that is slidable with respect to the longitudinal axis of the body 51. However, it is understood that a variety of actuation means are contemplated herein. For example, the actuation means 62 may additionally or alternatively comprise a lever, trigger, push button or other means of actuation. In the illustrated embodiment, the actuation means 62 also includes a plurality of knurls 63 and is concentrically disposed about a portion of the handle section 52. As will be described below, the actuation means 62 may aid the release of the cleaning head 58 from the body 51.

The handle section 52 may also include means for storing the handle 50, such as hanging the handle 50 on a hook, clip or another hanger. For example, the handle section 52 may comprise an opening 64, which may take the form of an oblong bore, formed through the handle section 52 such that the handle 50 may be hung from a small hook.

Figure 10:
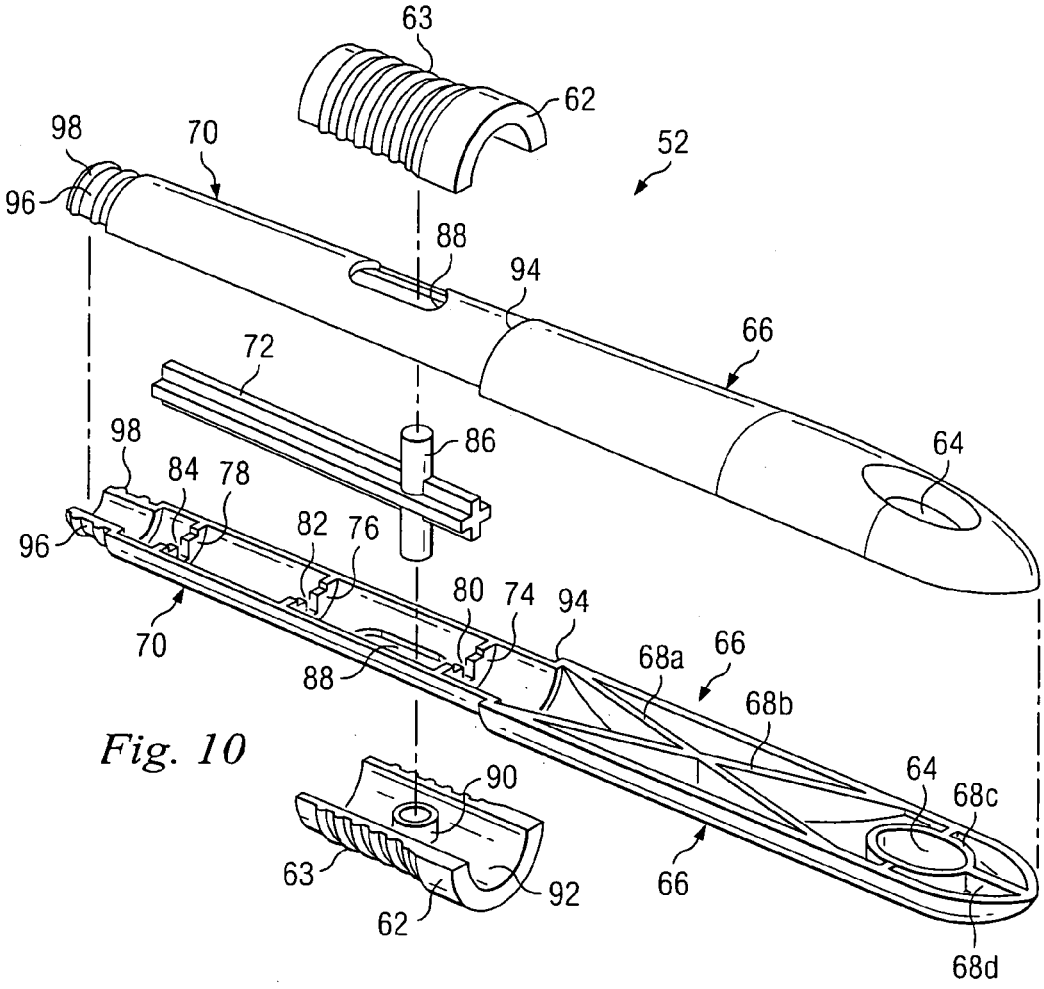
FIG. 10 illustrates an exploded perspective view of a portion of an embodiment of the handle shown in FIG. 8.

Referring to FIG. 10, illustrated is an exploded perspective view of a portion of an embodiment of the handle 50 shown in FIGS. 8 and 9. As shown in the illustrated embodiment, the handle section 52 of the body 51 may include a handle member 66 which may be partially hollow and may include a plurality of ridges 68*a-d* (halves of which are shown). The ridges 68*a-d* may take a variety of shapes so as to reinforce the handle member 66 or, alternatively, may be absent, thereby defining the handle member 66 as substantially hollow.

A housing section 70 may be coupled to or integrally formed with the handle member 66. In the illustrated embodiment, the housing section 70 houses a driver 72. Moreover, while the housing section 70 may be substantially hollow, it may nonetheless include a plurality of transversely disposed guides 74, 76 and 78 (halves of which are shown) having cross-like grooves or bores 80, 82 and 84 formed therethrough. The driver 72 may be an elongated member having a cross-like sectional shape corresponding with the guides 74, 76 and 78, such that upon seating the driver within the housing section 70, the guides 74, 76 and 78 receive the driver 72 in a corresponding engagement. Of course, the scope of the present disclosure does not limit the driver 72 and the guides 74, 76 and 78 to the particular shapes shown in FIG. 10, such that other shapes may be employed to encourage the engagement of the driver 72 and the guides 74, 76 and 78. For example, in another embodiment, the housing section 70 may be partially or substantially solid, possibly depending on the particular weight or support characteristics desired. In such an embodiment, the internal profile of the substantially solid housing 72 may correspond to the external profile of the driver 72.

In the illustrated embodiment, the driver 72 further includes a post 86, which may alternatively be formed as two posts, for extending through a pair of corresponding elongated slots 88 formed through the housing section 70. Each end of the post 86 may be secured to the actuation means 62 via a pair of receptacles 90 (one of which is shown) coupled to or integrally formed with and extending from an inner surface 92 of the actuation means 62, thereby coupling the driver 72 to the actuation means. The raised receptacles 90 may also extend through the elongated slots 88 to further guide the actuation means 62 on the handle section 52 of the body 51.

The handle section 52 may also include a step 94 from the handle member 66 to the housing section 70 such that one end of the actuation means 62 abuts the step 94, thus providing a stop for the actuation means 62. Accordingly, in one embodiment, the actuation means 62 may be axially movable via the cooperation of the post 86, the slots 88 and the receptacles 90, as further described below with respect to the operation of the handle 50. The handle section 52 may also include a connector 96 coupled to or formed integrally with the housing section 70. The connector 96 may include one or more knurls 98 for coupling to the middle section 54, as described below.

Figure 11:
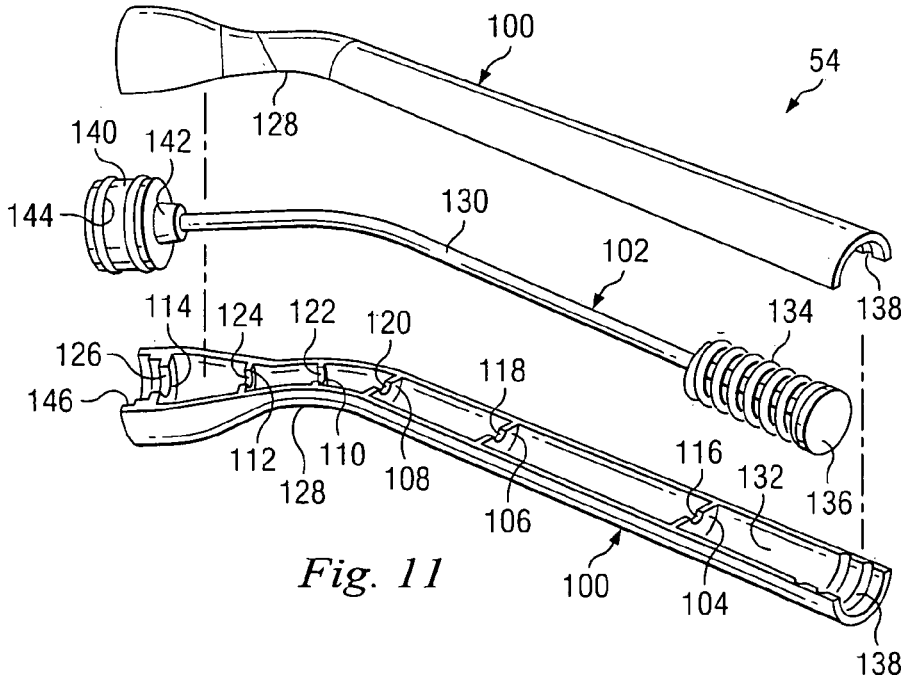
FIG. 11 illustrates an exploded perspective view of another portion of an embodiment of the handle shown in FIG. 8.

Referring to FIG. 11, illustrated is an exploded perspective view of another portion of the handle shown in FIGS. 8 and 9. The middle section 54 may include a housing 100 optionally formed to include a bend 128, such that the handle 50 may be used to clean the inner surface of a toilet bowl and other hard-to-reach places. The housing 100 may be substantially hollow with the possible exception of a plurality of transversely disposed guides 104, 106, 108, 110, 112 and 114 (halves of which are shown) having circular-like grooves or bores 116, 118, 120, 122, 124 and 126 formed therethrough. The housing 100 may also enclose a plunger mechanism 102 adapted to receive a translational force from the driver 72. The plunger mechanism 102 may include a drivable element 130 having a generally circular cross-section such that upon seating the plunger mechanism within the housing 100, the guides 104, 106, 108, 110, 112 and 114 receive the drivable element 130 in a corresponding engagement. The drivable element 130 may take the form of an elongated rod or wire, and may be flexible. Of course, non-circular shapes may also be employed for the engagement of the driver element 130 and the grooves 116, 118, 120, 122, 124 and 126.

The housing 100 may also include a spring compartment 132 for receiving a spring 134 concentrically disposed around a portion of the drivable element 130. The spring compartment 132 may also receive a cap 136 coupled to or formed integrally with the drivable element 130. The spring 134 may take the form of a variety of springs, such as a conventional compression spring. The spring compartment 132 may be of sufficient size to house the spring 134 in an unbiased state. The middle section 54 may also include one or more grooves 138 formed therein to receive the connector 96 of the handle section 52 in a coupling engagement.

The plunger mechanism 102 may also include a plunger head 140, possibly adapted to impart a translational force to the cleaning head 58 (see FIGS. 8 and 9). The plunger head 140 may include a protrusion 142 extending therefrom for coupling to the drivable element 130. The guide 114 and corresponding groove 126 may be sized to allow passage of the protrusion 142 while restricting movement of the plunger head 140 beyond the guide 114 so as to provide a stop mechanism for the plunger head 140. Of course, a variety of stop mechanisms may be employed other than the guide 114. The plunger head 140 may also include one or more O-rings 144 for preventing the passage of fluid as will be further described. The middle section 54 may also include a grooved portion 146 (half of which is shown) for coupling the middle section 54 to the cleaning head section 56 (see FIGS. 8 and 9). The cleaning head section 56 may also be formed integrally with them idle section 54.

Figure 12:
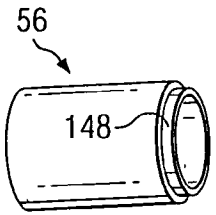
FIG. 12 illustrates a perspective view of one embodiment of a cleaning head section constructed according to aspects of the present disclosure.

Referring to FIG. 12, illustrated is a perspective view of one embodiment of the cleaning head section 56 shown in FIGS. 8 and 9. The cleaning head section 56 may house the plunger head 140 and receive the cleaning head 58 (see FIGS. 8 and 9). Accordingly, the cleaning head section 56 may include a connector 148 adapted to fit within the grooved portion 146 of the middle section 54, thereby coupling the cleaning head section 56 and middle section 54. In some embodiments, an adhesive may be employed to strengthen the connection between the cleaning head section 56 and the middle section 54.

Figure 13:
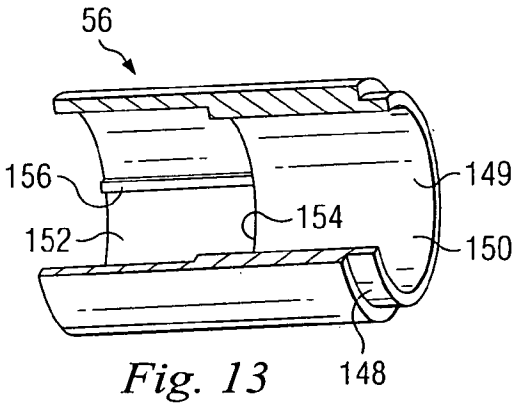
FIG. 13 illustrates a perspective view of the cleaning head section shown in FIG. 12 with a portion removed for clarity.

Referring to FIG. 13, illustrated is a perspective view of the cleaning head section 56 shown in FIG. 12 with a portion removed for clarity, As shown in FIG. 13, the cleaning head section 56 may include a step 154 along an inner surface 149 thereof to define a plunger portion 150 and a receiver portion 152. The plunger portion 150 may be defined as the portion of the cleaning head section 56 having a thicker width relative to the receiver portion 152. The plunger portion 150 may house the plunger head 140 when the plunger head is in an initial position. The receiver portion 152 may be defined as the portion of the cleaning head section 56 having a thinner width relative to the plunger portion 150. The receiver portion 152 may provide a receptacle for housing the cleaning head 58 when the cleaning head 58 is in a retained position.

The step 154 that divides the plunger portion 150 from the receiver portion 152 may also define a stop against which the cleaning head 58 is positioned. A plurality of longitudinally-extending ribs 156 (one of which is shown) may also be formed on the inner surface 149 of the cleaning head section 56 for gripping the cleaning head 58 when inserted in the cleaning head section 56.

Figure 14:
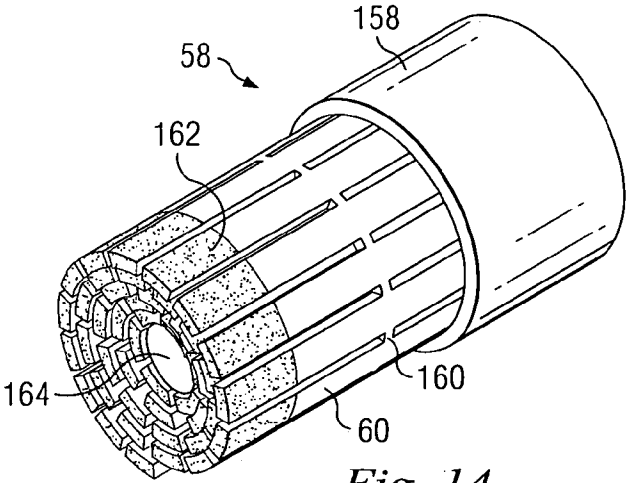
FIG. 14 illustrates a perspective view of one embodiment of a cleaning head constructed according to aspects of the present disclosure.

Referring to FIG. 14, illustrated is a perspective view of one embodiment of the cleaning head 58 shown in FIGS. 8 and 9 constructed according to aspects of the present disclosure. In one embodiment, the cleaning head 58 includes a receiving sleeve 158 that retains a portion of the cleaning means 60 and is adapted to be gripped and retained by the receiver portion 152, possibly via the ribs 156 upon insertion of the cleaning head 58. A variety of retaining means other than the receiving sleeve 158 are contemplated, including string, winding, adhesive and/or other materials. The cleaning means 60 may be retained by the receiving sleeve 158 and extend therefrom to define the portion of the cleaning head 58 that contacts an area to be cleaned. The cleaning means 60 and the receiving sleeve 158 may be formed of a variety of materials, including any biodegradable material such as paper. The cleaning means 60 may also comprise materials that are easily and safely flushed in a residential and/or industrial toilet.

In one embodiment, the cleaning means 60 comprise bristles, possibly attached to one another via a plurality of bridges 160. The bridges 160 may hold the bristles together and facilitate flaring of the bristles. The bristles may be positioned relative to one another in a variety of manners including a substantially spiral, concentric, folded or layered arrangement. The ends of the bristles or other cleaning means 60 opposite the receiving sleeve 158 may also form a generally concave cleaning surface. Among other purposes, the concave shape of the collective ends of the bristles or other cleaning means 60 may encourage the cleaning means 60 to flare in response to contact with a surface to be cleaned, thereby improving cleaning quality and efficiency.

A cleaning solution, generally depicted by reference numeral 162, may optionally be pre-applied to the cleaning means 60. Alternatively, or in addition to the cleaning solution 162, a chemical tablet 164 may be adhered in any conventional manner to the ends of the cleaning means 60 opposite the receiving sleeve 158. The chemical tablet allows a specified dose of a chemical substance, such as a cleanser and/or disinfectant, to be provided on the cleaning head 58. In one embodiment, the concavity of the cleaning means 60 provides a recess within which the chemical tablet 164 may be positioned.

Figure 15:
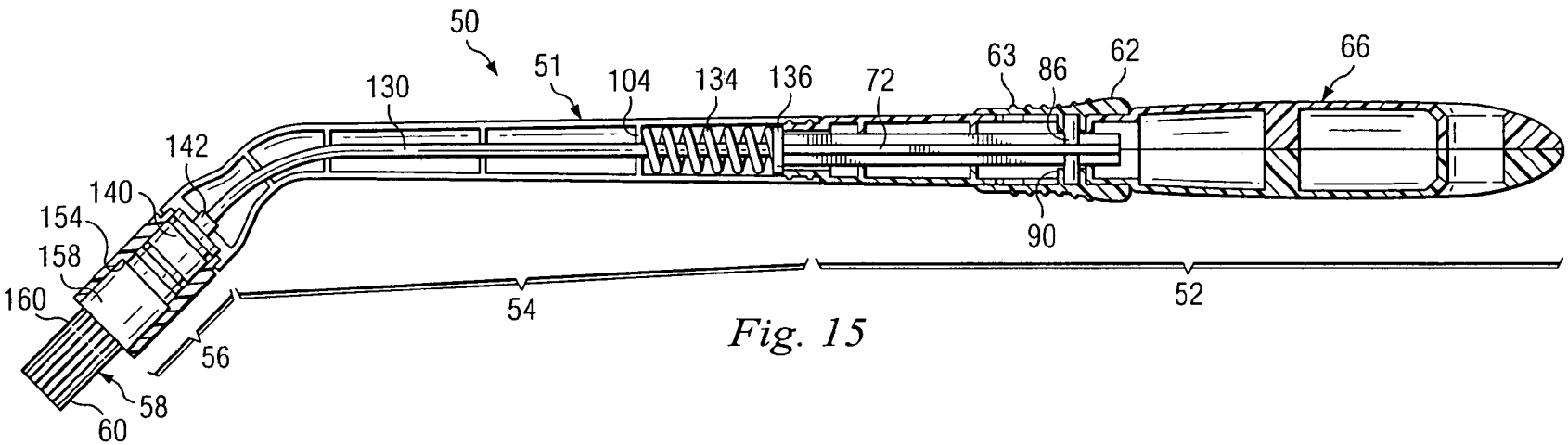
FIG. 15 illustrates a sectional view of an embodiment of the handle shown in FIGS. 8 and 9.

Referring to FIG. 15, illustrated is a sectional view of an embodiment of the handle 50 shown in FIGS. 8 and 9. In operation, the cleaning head 58 is inserted into the body 51 such that the receiving sleeve 158 of the cleaning head 58 engages the ribs 156 of the cleaning head section 56 (FIG. 11*b*) and abuts the stop 154. Upon insertion, the cleaning head 58 is retained in an initial position within the cleaning head section 56 and cleaning operations may commence.

During cleaning operations, the user holds the handle 50 and contacts the cleaning means 60 of the cleaning head 58 against a surface (not shown) to be cleaned, such as the interior of a toilet bowl. Various amounts of pressure may be applied by the user to the handle 50 such that the cleaning means 60 may flare out during cleaning, thereby cleaning a greater surface area. In embodiments in which the cleaning head 58 includes bristles, the bridges 160 connecting the bristles and the general concavity along the distal ends of the bristles may facilitate such flaring, or spreading, of the bristles, thereby maximizing the surface area cleaned during use of the handle 50.

In embodiments in which the O-rings 144 are disposed around the plunger head 140, fluid may be substantially prevented from passing beyond the plunger head 140 during cleaning of surfaces which are underwater. It is understood that during cleaning, the actuation means 62, the driver 72 and the plunger mechanism 102 are all in their initial positions.

Upon completion of the cleaning operations, the user may dispose of the cleaning head 58 by actuating the driver 72 via the actuation means 62. While holding the handle member 66, the user may grip the actuation means 62 with the aid of the knurls 63 formed thereon. The user may then apply a translational force to move the actuation means 62 toward the cleaning head section 56, which transfers such force via the post 86 to the driver 72, which in turn is moved distally to contact the cap 136. Movement of the driver 72 may force the cap 136 and the drivable element 130 in a distal direction, which biases the spring 134 against the guide 104 (see FIGS. 10 and 11).

Movement of the drivable element 130, in turn, may drive the plunger head 140 against the cleaning head 58 to urge and eventually eject the cleaning head 58 from the body 51. The plunger head 140 is driven such that it may become substantially flush with the distal end of the body 51, which facilitates removal of a used cleaning head 58. The cleaning head 58, preferably being formed of biodegradable and/or flushable materials, may simply be disposed of into a toilet and subsequently flushed. The user may then release the actuation means 62, which causes the spring 134 to return to its initial position, thereby returning the actuation means 62, the driver 72, and the plunger mechanism 102 to their initial positions.

Thus, the handle 50 enjoys the advantage of retaining a biodegradable cleaning head 58 while providing for the disposal thereof in a simple to use method and apparatus. Furthermore, use of the handle 50 eliminates the need to touch or store the cleaning head 58 after becoming contaminated with harmful germs and the like. Still further, by providing for retention of the cleaning head 58 within the body 51, the receiving sleeve 158 of the cleaning head remains relatively dry during use. Thus, weakening of the receiving sleeve 158 due to saturation is reduced. Even when the cleaning head 58 becomes somewhat wet during cleaning, the amount of swelling of the receiving sleeve 158 would not exceed the size of the ribs 156. Thus, the problem of jamming of the cleaning head 58 during ejection is also reduced. Also, the receiving sleeve 158 retains the cleaning means 60 even when the cleaning means 60 increases in size due to saturation.

Figure 16A:
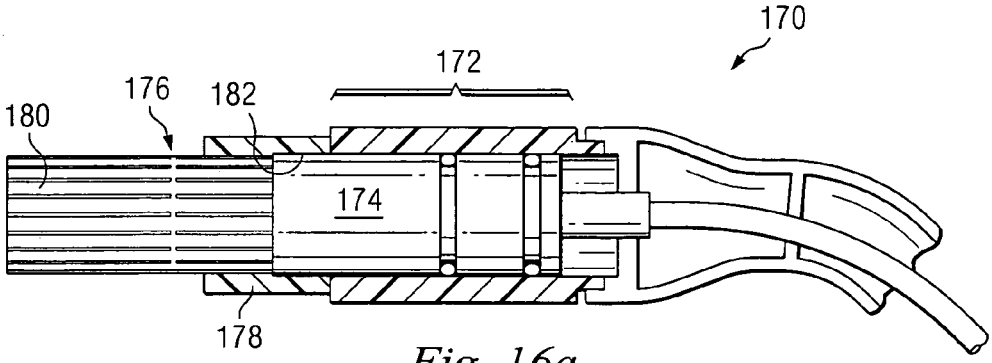
FIGS. 16*a*-16*c* each illustrate sectional views of a portion of another embodiment of a handle in successive stages of operation according to aspects of the present disclosure.
Figure 16B:
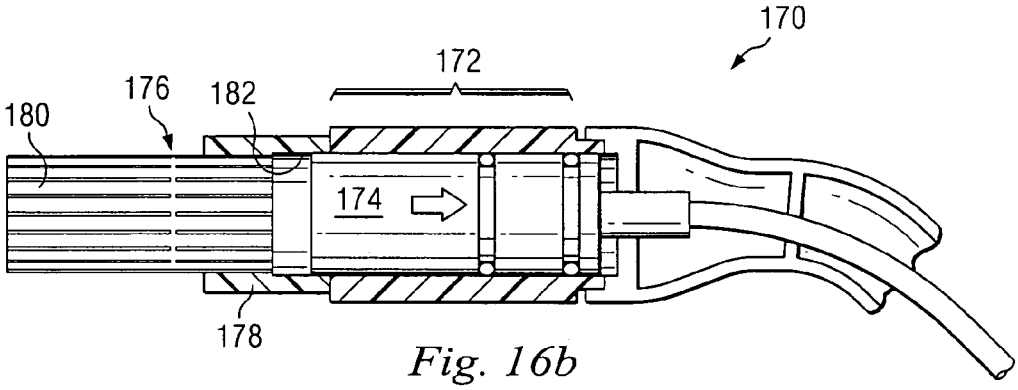
Figure 16C:
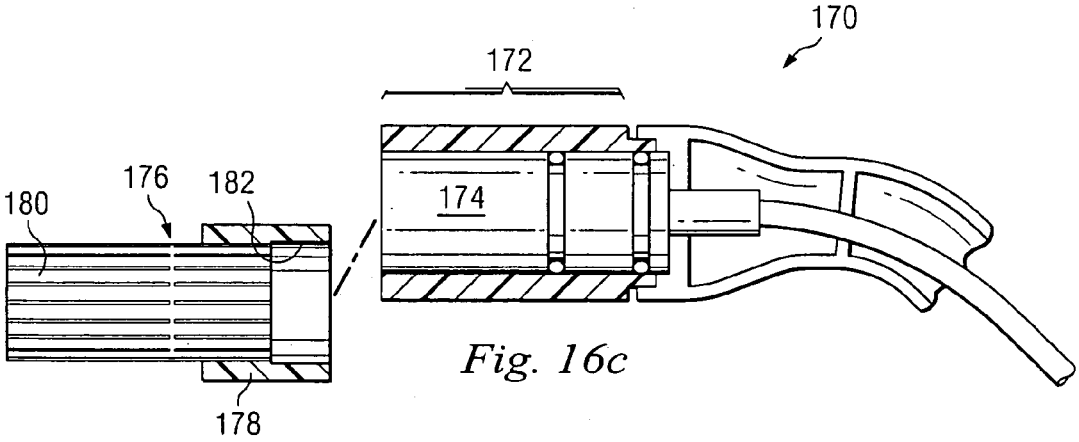

Referring to FIGS. 16*a-c*, illustrated are sectional views an alternative handle 170 (a portion of which is shown) constructed according to aspects of the present disclosure. The handle 170 includes a cleaning head section 172 for housing a plunger head 174. A cleaning head 176 associated with the handle 170 includes a sleeve 178, a portion of which is positioned around a plurality of bristles 180 to define a recessed portion 182. As shown more particularly in FIG. 16*a*, the cleaning head 176 may be adapted for a friction fit or interference fit with the plunger head 174 when the plunger head is in an initial position.

In operation, the cleaning head 176 is engaged with the plunger head 174 via the recessed portion 182 when the plunger head is in the initial position and cleaning operations may commence, as shown in FIG. 16*a*. Upon completion of the cleaning operations, the cleaning head 176 may be removed from the handle 170 by actuating a collar, pushing a button or otherwise operating an actuator operatively connected to the plunger head 174 to move the plunger head 174 to a second position, as shown in FIG. 16*b*. It is understood that the collar and the plunger head 174 may interact in a similar manner as described with respect to previous embodiments. Referring to FIG. 16*c*, when the plunger head 174 is retracted from the second position (or sooner), the cleaning head 176 may fall away from the handle 170 to be disposed of into a toilet, waste receptacle or the like.

Figure 17:
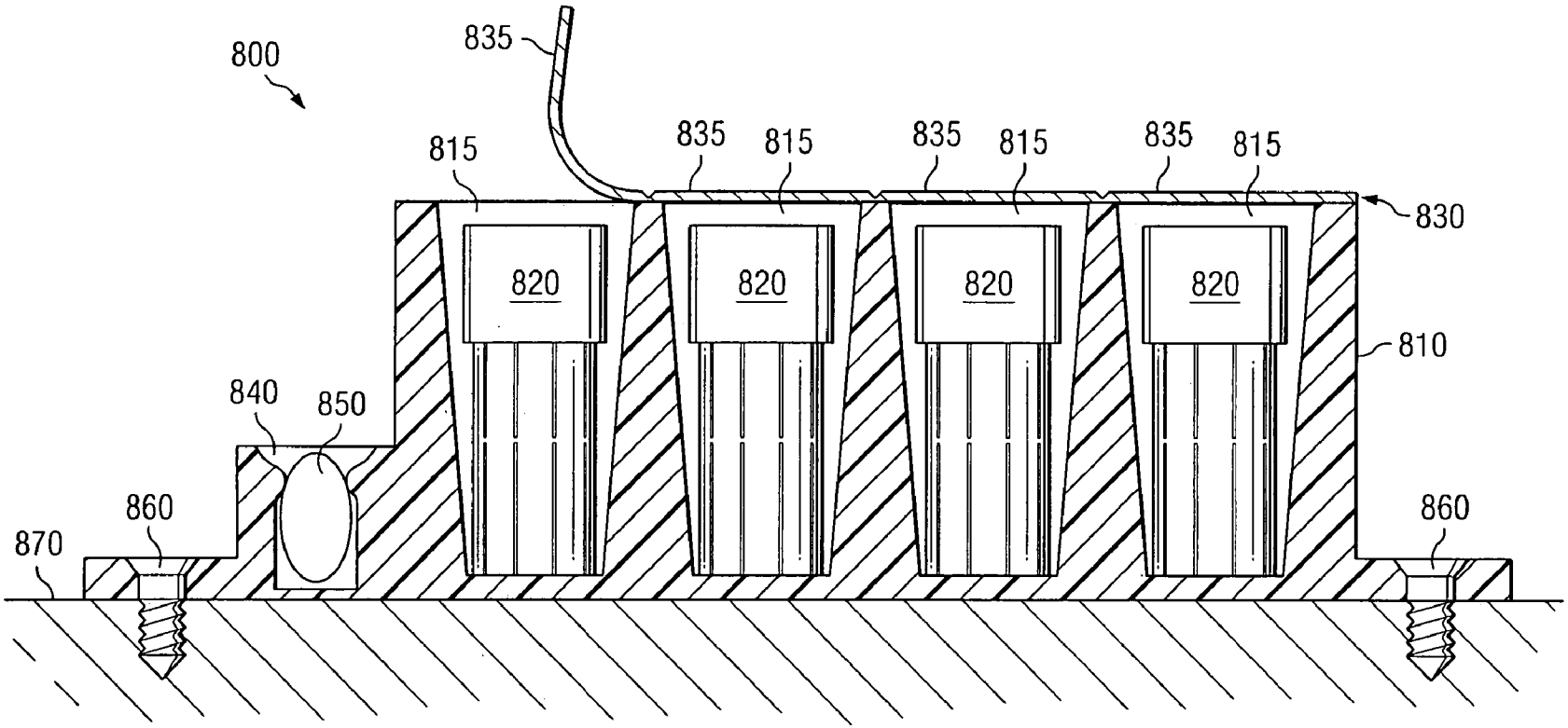
FIG. 17 illustrates a sectional view of one embodiment of a dispenser constructed according to aspects of the present disclosure.

Referring to FIG. 17, illustrated is a sectional view of one embodiment of a disposable cleaning head dispenser 800 constructed according to aspects of the present disclosure. The dispenser 800 includes a housing 810 and one or more disposable cleaning heads 820 stored in the housing 810. The housing 810 may comprise plastic, aluminum, paper products or other materials, and may be formed by injection-molding, press-forming, paper forming processes and/or other processes. The disposable cleaning heads 820 may be substantially similar to the cleaning head 58 shown in FIGS. 8, 9 and 14 and/or the cleaning head 176 shown in FIGS. 16*a*-16*c*. Moreover, while the dispenser 800 is illustrated as containing 4 disposable cleaning heads 820, the dispenser 800 may include any number of heads 820 within the scope of the present disclosure.

The dispenser 800 also includes a retainer 830 detachably coupled to the housing 810 and having a plurality of selectively removable portions 835 each providing access to a corresponding one of the plurality of disposable cleaning heads 820. For example, the retainer 830 may comprise a perforated foil or other material detachably adhered to the housing 810. In operation, one of the portions 835 of the retainer 830 may be punctured, peeled away and/or otherwise removed to provide access to one of the cleaning heads 820 without exposing the remaining cleaning heads 820. Moreover, each of the cleaning heads 820 may be individually housed within one of several compartments 815 within the housing 810. Accordingly, each of the disposable cleaning heads 820 may be individually sealed by one or more portions 835 of the retainer 830 within one of the housing compartments 815.

The dispenser 800 may also include means 840 for storing a handle 850 configured to detachably engage a selected one of the disposable cleaning heads 820. The handle 850 may be substantially similar to the embodiments described above. In the illustrated embodiment, the storage means 840 comprises a compartment within the housing 810. In other embodiment, the storage means 840 may comprise a hook extending from the housing 810 from which the handle 850 may be hung. Other means for storing the handle 850 within the dispenser 800 may include detachable adhesive, magnets, hook-and-loop fasteners, interference fit retaining, etc.

The dispenser 800 may also include an interface 860 for securing the dispenser 800 to a surface 870 of a furniture panel, a wall, a floor and/or other surfaces a user finds convenient. As in the illustrated embodiment, the interface 860 may comprise apertures for receiving threaded fasteners, and may comprise threaded fasteners retained in such apertures. In other embodiments, the interface 860 may comprise detachable or permanent adhesive, magnets, hook-and-loop fasteners, etc.

The compartments 815 may also be sized relative to the handle 850. That is, each of the compartments 815 may be configured to receive an end of a handle 850 to secure the handle 850 to a selected one of the disposable cleaning heads 820 before removing the selected disposable cleaning head 820 from the housing 810. For example, the outer diameter of a retaining end of the handle 850 may be at least slightly smaller than the inner diameter of each compartment 815. The compartments 815 may also be tapered, as shown in FIG. 17, to facilitate alignment of the handle 850 with the cleaning head 820.

Figure 18:
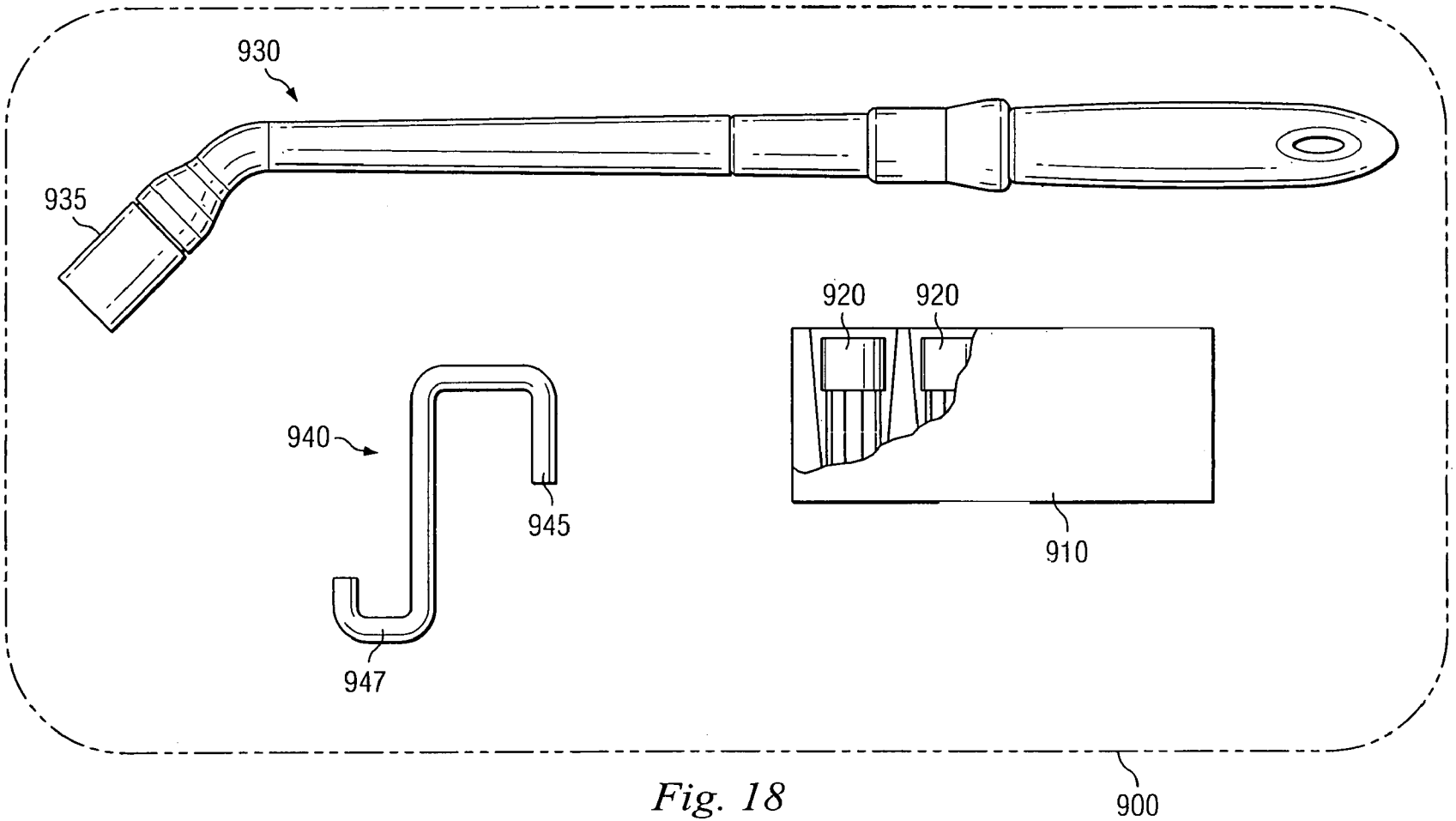
FIG. 18 illustrates a schematic view of one embodiment of a cleaning kit constructed according to aspects of the present disclosure.

Referring to FIG. 18, illustrated is a schematic view of one embodiment of a cleaning kit 900 constructed according to aspects of the present disclosure. In the illustrated embodiment, the cleaning kit 900 includes a dispenser 910 and one or more disposable cleaning heads 920 stored in the dispenser 910. The dispenser 910 may be substantially similar to the dispenser 800 shown in FIG. 17. The disposable cleaning heads 920 may be substantially similar to the cleaning head 58 shown in FIGS. 8, 9 and 14 and/or the cleaning head 176 shown in FIGS. 16*a*-16*c*. The dispenser 910 may include any number of cleaning heads 920 within the scope of the present disclosure.

The cleaning kit 900 also includes a handle 930 having an end 935 configured to detachably retain a selected one of the disposable cleaning heads 920. The handle 930 may be substantially similar to the handle 50 shown in FIG. 8, although the handle 50 may not include a cleaning head until one of the cleaning heads 920 is assembled with the handle 930, as described above.

The cleaning kit 900 may also include a hanging clip 940 configured to interface with a toilet, such that the handle 930 may be hung from the toilet via the hanging clip 940. For example, the clip 940 may include a first hook 945 configured to fit between the top edge of a toilet tank and the lid of the toilet tank, and a second hook 947 configured to fit into an opening in the handle 930. Accordingly, the handle 930 may be conveniently stored with the toilet, eliminating the storage hassle experienced with conventional toilet brushes.

Although embodiments of the present disclosure have been described in detail, those skilled in the art should understand that they can make various changes, substitutions and alterations herein without departing from the spirit and scope of the present disclosure.

What is claimed is:

1. A cleaning apparatus, comprising:

a handle having a substantially hollow tubular body with a proximal end and a distal end;

actuation means operably coupled to the tubular body, said actuation means including a plunger mechanism slidably disposed within said tubular body and a collar concentrically disposed around said tubular body near said proximal end of said tubular body, said collar being slidable between a first position and a second position and coupled to the plunger mechanism; and a cleaning head detachably coupled to said distal end of said tubular body;

wherein sliding the collar from said first position towards said second position actuates said plunger mechanism to eject the cleaning head from said distal end of said tubular body.

2. The cleaning apparatus according to claim 1, wherein said plunger mechanism disposed within the tubular body comprises a driver, a drivable element disposed adjacent to the driver, and a plunger head engaged with the distal end of the drivable element, said driver being operably coupled to the collar and the drivable element.

3. The cleaning apparatus according to claim 2, wherein sliding the collar towards the second position causes the plunger head to become substantially flush with the distal end of the tubular body.

4. The cleaning apparatus according to claim 3, wherein the tubular body comprises a pair of longitudinal slots and the driver comprises a post extending through the longitudinal slots for engagement with the collar.

5. The cleaning apparatus according to claim 2, wherein said handle comprises a receiver portion at the distal end of the tubular body to temporarily receive the detachable cleaning head, and said plunger head is disposed within the receiver portion, wherein actuation of the plunger head ejects the cleaning head from the receiver portion.

6. The cleaning apparatus according to claim 5, wherein the receiver portion has at least one rib configured to engage the cleaning head.

7. The cleaning apparatus according to claim 5, wherein at least one O-ring configured to prevent fluid flow into the tubular body is arranged between the plunger head and the receiver portion.

8. The cleaning apparatus according to claim 1, wherein the tubular body comprises a plurality of guides for receiving and guiding the plunger mechanism.

9. The cleaning apparatus according to claim 1, wherein the tubular body comprises at least two axially disposed sections.

10. The cleaning apparatus according to claim 1, wherein said cleaning head comprises a plurality of bristles having distal ends collectively forming a cleaning surface and a retainer securing the proximal ends of the plurality of bristles.

11. The cleaning apparatus according to claim 10, wherein the retainer is a sleeve.

12. The cleaning apparatus according to claim 10, wherein the plurality of bristles are arranged in a substantially spiral configuration.

13. The cleaning apparatus according to claim 10, wherein the cleaning surface is concave.

14. The cleaning apparatus according to claim 10, wherein the cleaning head comprises biodegradable materials and is flushable.

15. A cleaning apparatus, comprising:

a handle having a substantially hollow tubular body with a proximal end and a distal end, said tubular body comprising axially disposed a proximal section and a distal section;

actuation means operably coupled to the tubular body, said actuation means including a plunger mechanism slidably disposed within the proximal section and the distal section of the tubular body, said plunger mechanism being slidable between a first position and a second position and said plunger mechanism including a driver disposed within the proximal section of the tubular body, a drivable element disposed adjacent to the driver within the distal section of the tubular body, a plunger head engaged with the distal end of the drivable element, said driver being operably coupled to the drivable element, and a collar concentrically disposed around the proximal section of the tubular body near the proximal end, said collar being slidable between a first position and a second position and coupled to the driver, a spring concentrically disposed around a portion of the drivable element, and a cap engaged with the proximal end of the drivable element and disposed adjacent to the spring; and a cleaning head detachably coupled to the distal end of the tubular body;

wherein sliding the plunger mechanism from the first position towards the second position ejects the cleaning head from the distal end of the tubular body.

16. The cleaning apparatus according to claim 15, wherein the proximal section of the tubular body comprises a pair of longitudinal slots and the driver comprises a post extending through the longitudinal slots for engagement with the collar.

17. The cleaning apparatus according to claim 15, wherein said handle comprises a receiver portion at the distal end of the distal section of the tubular body to temporarily receive the detachable cleaning head, and said plunger head is disposed within the receiver portion, wherein actuation of the plunger head ejects the cleaning head from the receiver portion.

18. The cleaning apparatus according to claim 17, wherein the receiver portion has at least one rib configured to engage the cleaning head.

19. The cleaning apparatus according to claim 17, wherein at least one O-ring configured to prevent fluid flow into the tubular body is arranged between the plunger head and the receiver portion.

20. The cleaning apparatus according to claim 15, wherein the distal and the proximal sections of the tubular body comprise a plurality of guides for receiving and guiding the plunger mechanism.

21. The cleaning apparatus according to claim 15, wherein said cleaning head comprises a plurality of bristles having distal ends collectively forming a cleaning surface and a retainer securing the proximal ends of the plurality of bristles.

22. The cleaning apparatus according to claim 21, wherein the retainer is a sleeve.

23. The cleaning apparatus according to claim 21, wherein the plurality of bristles are arranged in a substantially spiral configuration.

24. The cleaning apparatus according to claim 21, wherein the cleaning surface is concave.

25. The cleaning apparatus according to claim 21, wherein the cleaning head comprises biodegradable materials and is flushable.

* * * * *